United States Patent [19]

Michalik et al.

[11] 4,211,396

[45] Jul. 8, 1980

[54] WEB-FED ROTARY PRINTING PRESS

[75] Inventors: Horst B. Michalik, Hochberg; Otto T. Weschenfelder, Wurzburg, both of Fed. Rep. of Germany

[73] Assignee: Koenig & Bauer Aktiengesellschaft, Wurzburg, Fed. Rep. of Germany

[21] Appl. No.: 933,342

[22] Filed: Aug. 14, 1978

[30] Foreign Application Priority Data

Aug. 23, 1977 [DE] Fed. Rep. of Germany ..... 2737858

[51] Int. Cl.[2] ..... B41F 13/64

[52] U.S. Cl. ..... 270/13; 270/21; 270/47; 270/60

[58] Field of Search ..... 270/4, 10, 19, 21, 64, 270/13, 70–72, 74–77, 47–50, 60

[56] References Cited

U.S. PATENT DOCUMENTS 1,373,215 3/1921 Walser ..... 270/10

FOREIGN PATENT DOCUMENTS 565365 11/1944 United Kingdom ..... 270/71

1106210 3/1968 United Kingdom ..... 270/70

*Primary Examiner*—Edgar S. Burr

*Assistant Examiner*—Heinz A.

*Attorney, Agent, or Firm*—Jones, Tullar & Cooper

[57] ABSTRACT

A web-fed rotary printing press apparatus for the production of printed products of various sizes is disclosed. The apparatus includes forme cylinders having removable printing formes of different sizes, adjustably positionable cross cutting cylinders, speed varying means for the collecting and transfer cylinders, and a longitudinal folding device. As the number and size of printing formes on the forme cylinder is varied to change the size of the printed product, the position of the cross cutting cylinders and the speeds of the collecting and transfer cylinders are selectively varied so that the different sized printed products will be correctly severed and folded into signatures.

1 Claim, 3 Drawing Figures

WEB-FED ROTARY PRINTING PRESS

FIELD OF THE INVENTION

The present invention is directed to a web-fed rotary printing press assembly. More particularly, the present invention is directed to a printing press assembly capable of printing different sized products. Most specifically, the printing press assembly in accordance with the present invention includes means for adjusting the position and speeds of various of the components to allow printing and folding of various sizes of products.

A printing assembly is provided in which the number and size of printing formes or plates attached to the forme cylinders can be varied to change the size of the printed product. Since the size of the printed product varies with the size of the printing plates, the cross cutting cylinders are adjustably positionable to sever the printed web at the proper location after it has been printed. The severed webs are then advanced to collecting or take over and transfer cylinders whose speeds are also adjustable so that the grippers on the cylinders will contact the leading edges of the different sized severed webs. A pair of spaced conveyor tape assemblies are also operable at various speeds to transfer the severed webs to a longitudinal folding device and to space the severed webs properly so that each severed web segment can be folded before the next one is received.

DESCRIPTION OF THE PRIOR ART

Web-fed rotary printing presses for use in printing various sizes of products are known generally in the art and are used in rotogravure printing. The conventional way to vary the size of the printed product has been to replace the forme cylinders with other cylinders of differing diameters. By varying the diameter of the forme cylinders, different sized products can be printed, severed, and folded without varying the dimensions or speed of the folder. However, in the use of web-fed offset and letterpress rotary machines, it is not feasible to vary the size of the printing cylinder since there are a plurality of forme cylinders, pressure cylinders and the like which would all have to be removed and replaced. It has, accordingly, been necessary to completely change the printing unit or to change complete cylinder groups where it was necessary to vary the size of the printed product.

SUMMARY OF THE INVENTION

It is an object of the present invention to provide a web-fed rotary printing press which is capable of printing various sizes of products.

Another object of the present invention is to provide a web-fed rotary printing press having printing cylinders capable of accepting various numbers of different sized printing formes or plates.

Yet another object of the present invention is to provide a web-fed rotary printing press assembly in which the position of the cross cutting cylinders is adjustable.

Still a further object of the present invention is to provide a web-fed rotary printing press assembly in which the speed of rotation of the collecting and transfer cylinders can be varied in accordance with the size of the printed product.

As will be discussed in greater detail in the description of the preferred embodiment, the web-fed rotary printing press assembly in accordance with the present invention includes one or more forme cylinders in which the number and size of the printing formes or plates secured to the cylinders may be varied to vary the size of the printed product. The cross cutting cylinder apparatus is adjustably secured so that it can move to accommodate size changes such that the printed web will be severed between printed portions. The collecting or take over and transfer cylinders are equipped with variable speed drive means so that their grippers will contact the leading edge of each severed web, regardless of its size. A variable speed signature accelerating section is also provided to transfer the signatures to a longitudinal folding device in a suitably spaced array so that each signature can be properly folded. The web-fed rotary printing press assembly in accordance with the present invention is capable of printing various sizes without the necessity of replacing either the forme cylinder or cylinder group or complete printing units. Rather, changes in size are affected by replacing printing formes or plates and by adjusting the position of the cutting cylinders and the speeds of the collecting and transfer cylinders and the accelerating conveyor.

BRIEF DESCRIPTION OF THE DRAWINGS

While the novel features of the web-fed rotary printing press in accordance with the present invention are set forth with particularity in the appended claims, a full and complete understanding of the invention may be had by referring to the detailed description of a preferred embodiment as set forth hereinafter and as shown in the accompanying drawings in which:

DESCRIPTION OF A PREFERRED EMBODIMENT

Figure 1:
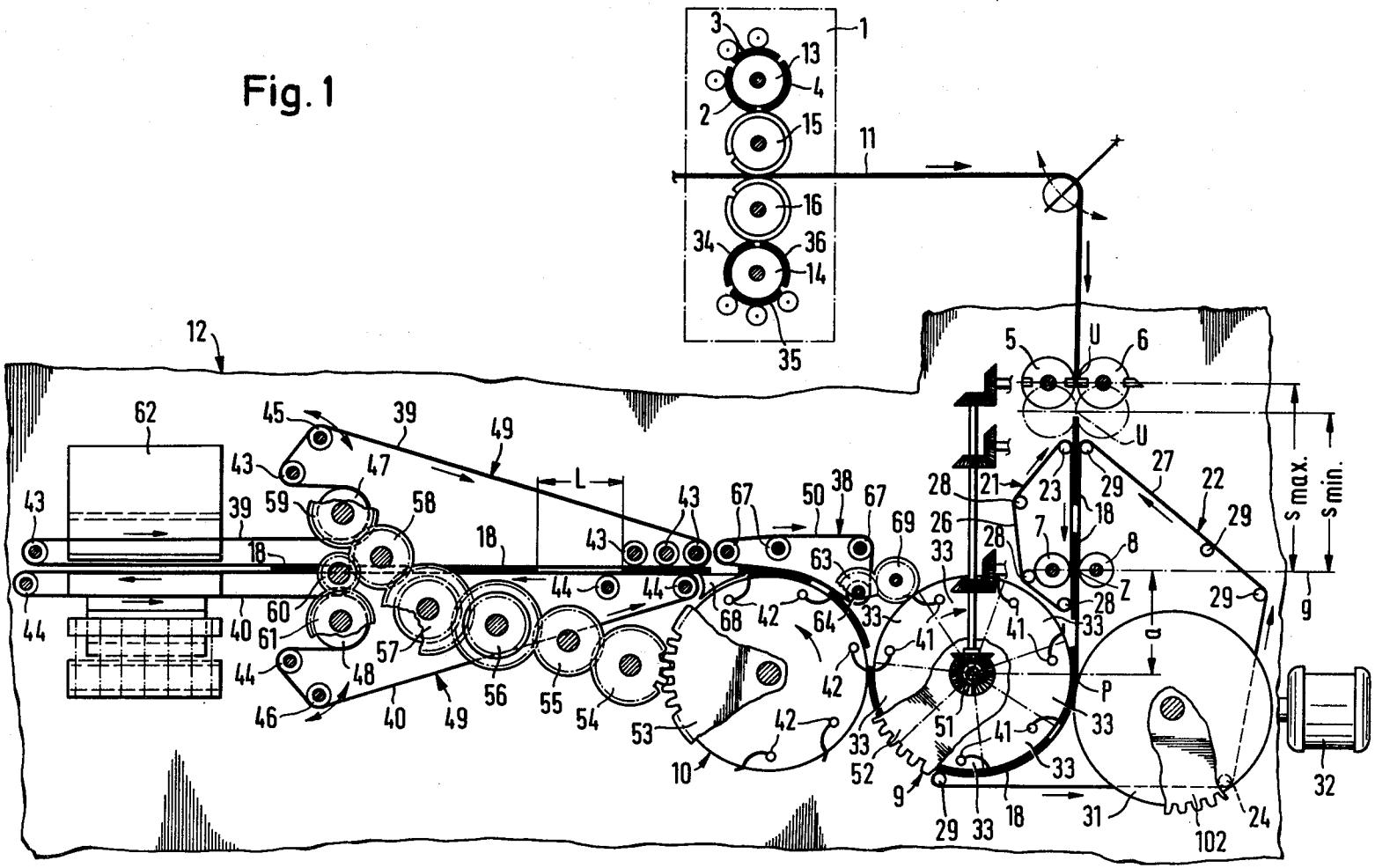
FIG. 1 is a schematic side elevation view, partly in section, of a web-fed rotary printing press in accordance with the present invention.

Turning now to FIG. 1, there may be seen a preferred embodiment of a web-fed rotary printing press assembly in accordance with the present invention. As may be seen in FIG. 1, a paper web 11 comes from one printing unit or from a plurality of printing units generally at 1 and is fed into a folder assembly 12. The feed of the paper web 11 into the folder 12 is effected by conventional means such as former or turning bars (not shown). The printing unit 1 may be a letterpress printing unit, a rotogravure printing unit, an offset printing unit, or other known printing unit. In the embodiment shown in the drawing, printing unit 1 is an offset printing unit. It comprises, for example, forme cylinders 13, and 14 having printing formes 2, 3, 4, and 34, 35, 36 respectively, secured thereto, and blanket cylinders 15 and 16; all of which are driven by a main drive 32.

The upper web 11 leaves the printing unit 1 and passes cutting cylinders 5, 6. These cross cutting cylinders 5, 6 are vertically adjustable in accordance with the size being printed, within the cutting range of $s_{min.}$ to $s_{max.}$, as shown in FIG. 1, in relation to a pair of feed rolls 7 and 8, so that when the cutting procedure is terminated near the point U, the feed rolls 7 and 8 grasp a severed signature of sheets 18 at its leading edge at point Z. The paper web 11 is conveyed to the point of severence U from the printing unit 1 at the peripheral speed of the blanket cylinders 15, 16. The cutting cylinders 5, 6 as well as the feed rolls 7, 8 rotate at the peripheral speed of a collecting or take-over cylinder 9. The feed rolls 7, 8 are positioned with respect to the collecting cylinder 9 in such a manner, that the distance "a" between their centers is less than $s_{min.}$, so that the signature of sheets 18 which is gripped by the grippers 41 of the collecting cylinder 9 at point P is conveyed to point P by the feed rolls 7, 8. Cooperating driven tape systems 21, 22 assist in conveying the signatures of sheets 18 to the collecting cylinder 9. The peripheral speed of tape systems 21 and 22 is the same as the peripheral speed of the collecting cylinder 9. Their drive is effected by means of tape rollers 23, 24, with the conveyor tapes 26, 27 being guided in guide rollers 28, 29.

In the printing units 1, the forme cylinders 13, 14 and the blanket cylinders 15, 16 have a constant diameter, and their peripheries are evenly divisable by 2, 3, 4, or 5. Accordingly, it is possible to fix 2, 3, 4, or 5 printing formes 2, 3, 4, 34, 35, 36 of the same length on the periphery of the forme cylinders 13 and 14. For example, if the periphery of the forme cylinders 13, 14 is 1260 mm, it is possible to dispose two printing formes of 630 mm of length, or three printing formes of 420 mm of length, or four printing formes of 315 mm of length, or five printing formes of 252 mm of length on the periphery of the forme cylinders 13, 14. While the variability of size of the forme cylinders 13, 14 is achieved by enlarging or by reducing the size of the individual printing formes, the variability of the cutting cylinders 5, 6 and of the collecting cylinder 9 is achieved by a modification of their peripheral speed. A gear drive unit 31 is interposed between the main drive 32 for the folder 12 and the gear train for the collecting cylinder 9, the cutting cylinders 5, 6, the feed rolls 7, 8 and the tape rollers 23, 24. Since signatures of sheets 18 of four different sizes; i.e., 630 mm, 420 mm, 315 mm, and 252 mm of length, are to be produced, drive gear unit 31 is provided with four different grades of speed I, II, III, IV. The transmission rations are, in the order mentioned above, 1:1.5:2.0:2.5.

Collecting cylinder 9 is constructed as a so-called seven field cylinder, that is as a cylinder having a peripheral surface divided into seven fields 33, as may be seen in FIG. 1. Each of the fields 33 is equipped with a signature conveyor or gripper means 41, such as pins or grippers which are operable in a conventional manner. The fields 33 are dimensioned for the maximum size length; the length of the signature of sheets 18 in the present embodiment of the invention being 630 mm, plus an additional space. The length of the fields 33 cannot be modified. The collecting cylinder 9 may be switched over in a conventional manner from collect run production to double production. It would also be possible to construct the collecting cylinder 9 as a mere conveyor cylinder; i.e., as a taking over cylinder 9, which therefore would not permit any collecting procedure.

As the cutting cylinders 5, 6 of the embodiment shown in the drawings have a fixed periphery, it is necessary to have them driven with different speeds, in order to enable the production of signatures of sheets 18 of different lengths, since the speed of the infed paper web 11 remains constant. Thus, the cutting cylinders 5, 6 rotate, in the gear position I, with a peripheral speed which is the same as the speed of the paper web 11, and as each of them is equipped with two cutting blades or counter cut bars, respectively, two signatures of sheets 18, each of 630 mm, are produced with one rotation of the cutting cylinders 5, 6. The signatures of sheets 18 arrive at the paper web speed between the feed rolls 7, 8, which convey the signatures of sheets 18 to the tape systems 21, 22, from where they are taken by the signature conveyor means 41 of the collecting cylinder 9. If signatures of sheets 18 of a length of 420 mm are to be produced, the gear mechanism 31 is switched to gear position II, the result of which is that the cutting cylinders 5, 6, now rotate with 1.5 times the basic speed and produce signatures of sheets 18, the length of which is only 420 mm. These signatures of sheets 18 arrive with paper web speed in the tape system 21, 22, the periheral speed of which, as well as of the feed rolls 7, 8 and the collecting cylinder 9, is now in gear position II, the 1.5 multiple of the peripheral speed. The signature of sheets 18, which is moving initially at paper web speed, is accelerated by the feed rolls 7, 8 to the higher speed of position II so that the signature of sheets 18, after having left the feed rolls 7, 8, has a speed equal to the peripheral speed of the collecting cylinder 9.

If signatures of sheets 18 of a length of 315 mm are to be produced, the gear unit 31 is switched over into the gear position III. This means that the cutting cylinders 5, 6, the tape systems 21, 22, the feed rolls 7, 8, and the collecting cylinder 9 have a peripheral speed which is twice as fast as in gear position I for a length of the signatures of sheets 18 of 630 mm. If signatures of sheets 18 of a length of 252 mm are to be produced, the gear unit 31 is brought into gear position IV. By this measure, the cutting cylinders 5, 6, the tape systems 21, 22, the feed rolls 7, 8, and the collecting cylinder 9 are brought into a peripheral speed which is 2.5 times as fast as their peripheral speed in the gear position I.

The principle of the present invention is to produce signatures of sheets 18 of different lengths, in the present case of 630 mm down to 252 mm, and to convey them to a collecting cylinder 9 of a specific size at a speed which may be varied. If the peripheral speed of the collecting cylinder were constant, its signature conveyor means 41 would only be capable of taking signatures of sheets 18 of maximum length. If shorter signatures of sheets 18 were transferred to the collecting cylinder 9, the signature conveyor means 41 would not be capable of gripping the signatures of sheets 18. For example, in the case of a reduction of size of the signatures of sheets 18 from 630 mm to 315 mm, the front edge of the 315 mm signatures of sheets 18 would be positioned exactly between two signature conveyor means 41, so that the signature would not be engaged by the signature conveyor means 41, even if the speed of the signatures of sheets 18 were equal to the peripheral speed of the collecting cylinder 9. In order to achieve a satisfactory pick up of the signatures of sheets 18 by the collecting cylinder 9, the distance "a" between the contact point P on the collecting cylinder 9 and the straight line "g" passing through the centers of the feed rolls 7, 8 is constant, but is smaller than the minimum size signature to be handled. As discussed above, the cutting range "s" between the centers of the cutting cylinders 5, 6, and the feed rolls 7, 8 is variable according to the length of the signature. The position of the centers of the feed rolls 7, 8, however, is fixed. Due to these two distances as described above, the front edge of the signature of sheets 18 enters the feed rolls 7, 8 with paper web speed and is accelerated according to the speed selected in gear unit 31. After being seized by the feed rolls 7, 8, the signature of sheets 18 is conveyed with a speed equal to the peripheral speed of the collecting cylinder 9. The signature of sheets 18 is thus engaged by the signature conveyor means 41 at the sheet contact point P without undergoing any damage.

The signatures of cut sheets 18 are taken over by the signature conveyor means 41, for example, the pins or grippers of the collecting cylinder 9 which are controlled in a conventional manner, and are transferred by them to a signature conveyor means 42, for example, pins or grippers, of a conveyor cylinder 10. The conveyor cylinder 10 is preferably a cylinder with seven fields. A signature conveyor system 38 is coordinated to the conveyor cylinder 10. It is the object of the signature conveyor system 38 to press the signatures of sheets 18 released by the signature conveyor means 42 of the conveyor cylinder 10 onto the periphery of the conveyor cylinder 10, and to feed by means of endless tapes 50 rotating with the peripheral speed of the conveyor cylinder 10 the signatures of sheets 18 via deflecting devices 68 into an accelerating track 49 for the signatures of sheets 18, which is arranged in tandem to the tapes 50.

Signature conveyor system 38 is comprised of four tapes 50 disposed one beside the other, guided by means of guide rollers 67, and commonly driven by means of a tape roller 64. The drive of the tape roller 64 is effected by means of toothed wheels 63 and 69. The toothed wheel 69 meshes with the toothed wheel 52. The tapes 50 have the same peripheral speed as the collecting cylinder 9 and contact the signatures of sheets 18.

Figure 3:
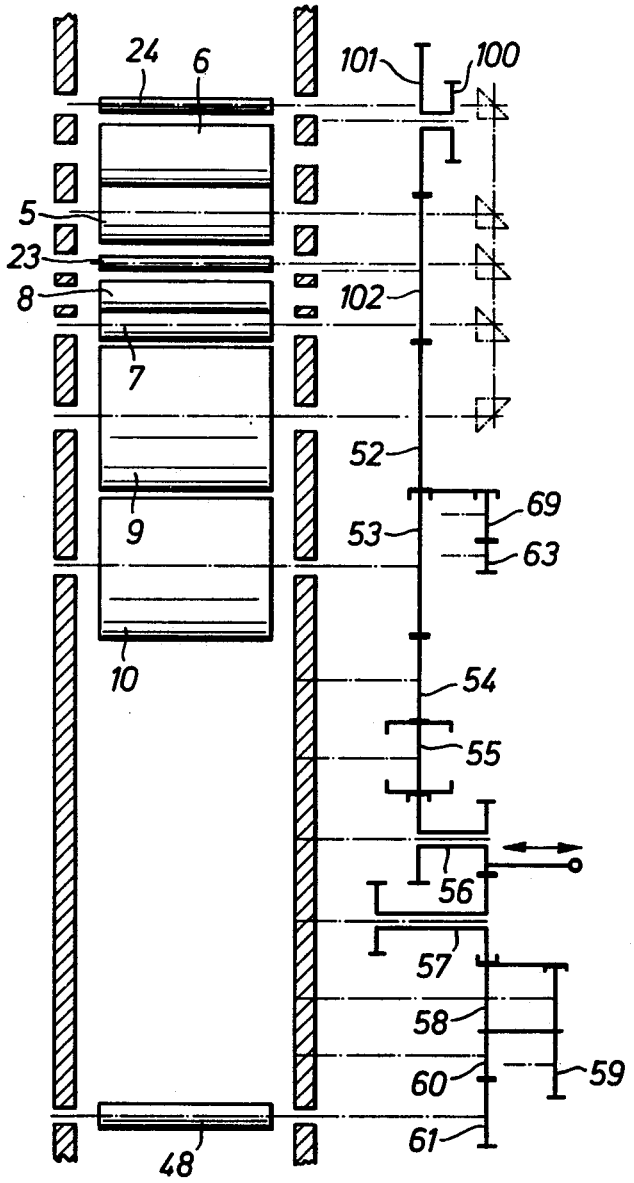
FIG. 3 is a schematic view of the gearing arrangement of the web-fed rotary printing press in accordance with the present invention and showing the means for varying speeds.

Acceleration track 49 is positioned in tandem to the signature conveyor system 38 for the signatures of sheets 18 and comprises, in the embodiment described in the present application, four upper tapes 39 and four lower tapes 40, all of which are driven at the same peripheral speed. The upper tapes 39 are guided over upper guide rollers 43, their common drive being effected by means of a ribbed upper tape roller 47 by means of a drive wheel 59. In order to keep the upper tapes 39 tightened, an upper tape tensioning device 45 is provided. The lower tapes 40 are guided over lower guide rollers 44. The tension of the lower tapes 40 is maintained by means of a lower tape tensioning device 46, their drive being executed by means of a lower tape roller 48. The drive of the upper tapes 39 and the lower tapes 40 is executed by means of the gear train 51 to 61 as shown in FIGS. 1 and 3. The toothed wheel 51 is the gear driving the feed rolls 7, 8, the toothed wheel 52 is the gear driving the collecting cylinder 9, the toothed wheel 53 drives the conveyor cylinder 10, the toothed wheel 61 drives the lower tape roller 48, and the toothed wheel 59 drives the upper tape roller 47. The toothed wheels 56 and 57 are provided, in this embodiment, as double toothed wheels, the toothed wheel 56 being a sliding gear so that it is possible to achieve a common switching over of the rotational speed of the upper and lower tapes 39, 40 between a rotational speed which is equal to, or one which is twice as fast as the peripheral speed of the collecting cylinder 9 or the conveyor cylinder 10. The upper tapes 39 and the lower tapes 40 pass through a conventional longitudinal folding device 62. The longitudinal folding device 62 is synchronously driven with the acceleration track 49, its drive being effected from the toothed wheel 59.

The upper tapes 39 and the lower tapes 40 of the acceleration track 49 rotate, if the collecting cylinder 9 is switched over to "double production", or if cylinder 9 operates as a non-collecting cylinder, with a speed which is double the peripheral speed of the cylinders 9 and 10. Thus it is possible to artificially provide a gap "L" between the signatures of sheets 18, which follow each other when the collecting cylinder 9 is operating in "double production" or as a non-collecting cylinder. If the collecting cylinder 9 is provided as a collecting cylinder and has been switched over to "collect run production", however, only each second field 33 of the collecting or take-over cylinder 9 is occupied. Thus, the gap L is automatically formed between each two of the signatures of sheets 18. Therefore, it is not necessary in this case for the upper tapes 39 and the lower tapes 40 of the accelerating track 49 to rotate at twice the peripheral speed of the cylinders 9 and 10. In this case the upper tapes 39 and the lower tapes 40 rotate with the same peripheral speed as the cylinders 9 and 10.

It will be obvious that one may dispense with the longitudinal folding by means of the former, and that in its place, in a conventional manner, a so-called turner bar infeed could be used, in which large paper ribbons are longitudinally cut by means of cutting knives, are placed one onto the other by means of turner bars, and are then conveyed to the cross folding device.

Figure 2:
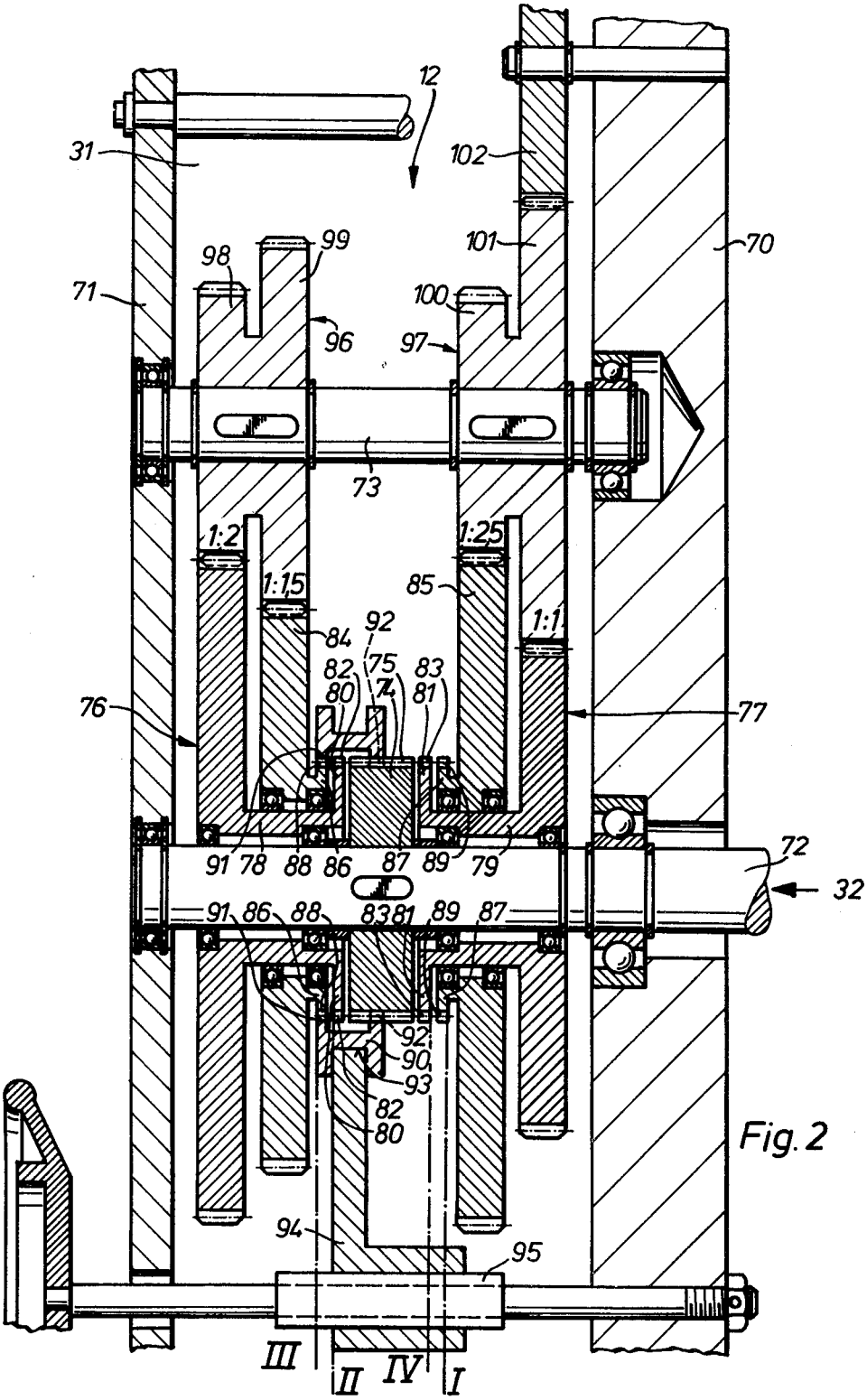
FIG. 2 is a schematic view, partly in section, of a portion of the drive gearing of the web-fed rotary printing press of the present invention.

Gear unit 31 is shown in FIG. 2 and is used to switch the collecting cylinder 9 and the feed rolls 7, 8 to one of the different peripheral speeds. As may be seen in FIG. 2, shafts 72 and 73 are supported in the side frame 70 of the folder 12 and in a support 71 fixed to the side frame. By means of the shaft 72, the input to the gear unit 31 is provided from main drive 32 at the rotational speed of the forme cylinders 13, 14 of the printing unit 1. A toothed wheel 74 having external teeth 75 is keyed onto the shaft 72 approximately midway between the side frame 70 and the support 71. To the left of the toothed wheel 74, a toothed wheel 76, and to the right of wheel 74, a toothed wheel 77 are rotatably supported on the shaft 72. Both toothed wheels 76, 77 have extended hubs 78 and 79, which end in closing disks 80 and 81. Each of the closing disks 80 and 81 has an external toothing 82 or 83 on its front side. Spur gears 84 and 85 are rotatably supported on hubs 78 and 79, respectively. Spur gears 84, 85 are joined to closing disks 86 or 87 respectively, which are each equipped with an external toothing 88 or 89. The external toothings 75, 82, 83, 88, and 89 have the same module and the same pitch circle and crown line. The closing disks 87, 81, or 80, 86 respectively are disposed side by side, and either on the right hand or the left hand near the toothed wheel 74. A push sleeve 90 equipped with two internal gear rings 91, 92 is capable of being alternatingly moved in the external toothing 82, 83, 88, 89 of the closing disks 80, 81, 86, 87. A notch 93 provided in the push sleeve 90 contacts a control fork 94 which may be shifted horizontally by means of a mechanism 95.

By means of movement of the push sleeve 90, it is possible to switch the gear unit 31 into the different gear positions I, II, III, IV. If the internal gear ring 92 meshes with the external toothing 75 of the toothed wheel 74, the internal gear ring 91 may be made to mesh alternatingly with the external toothing 82 or 88 of the closing disks 80 and 86 (in the gear positions II, III). If the internal gear ring 91 meshes with the external toothing 75 of the toothed wheel 74, the internal gear ring 92 may be made to mesh, by shifting the push sleeve 90 to the right, with the external toothing 83, 89 of the closing disks 81, 87 (in the gear positions I, IV). Double toothed wheels 96 and 97 are keyed onto a shaft 73. Spur gears 98, 99 of the double toothed wheel 96 mesh continuously with the toothed wheels 76 and 84. Spur gears 100 and 101 of the double toothed wheel 97 mesh continuously with the toothed wheels 77 and 85. A spur gear 102 is engaged with the spur gear 101, and provides for the input to the collecting cylinder 9 by means of the toothed wheel 52 and thus to the devices 10, 49, 38, 62, the feed roll group 7, 8, the tape systems 21, 22, and the cutting cylinder group 5, 6. Thus the gear unit 31 provides for the control of the speed of the components of the folder 12 in proportion to the speed of the press 1 to allow the folder to properly fold different sized signatures printed by press 1.

It will be seen that a preferred embodiment of a web-fed rotary printing press which is capable of printing products of different sizes has been set forth fully and completely hereinabove. It will, however, be obvious to one of ordinary skill in the art that a number of changes in, for example, the structure of the gear unit 31, the number of fields on the collecting and transfer cylinders 9 and 10, and their gripper means 41 and 42, the number of tapes in the conveyors 22, 38, and 49, the structure of the longitudinal folder 62, and the like may be made without departing from the true spirit and scope of the present invention and that the invention is to be limited only by the following claims.

We claim:

1. A web-fed rotary printing press assembly for printing a web, for severing the web at the proper locations after it has been printed, and for folding various sized printed products, said assembly comprising:

a printing press having one or more forme cylinders, each of said forme cylinders being of an evenly divisible peripheral size to receive varying numbers of printing formes, said varying numbers of printing formes being of different sizes to allow the printing of various sized products, the number of said printing formes secured to said peripheral surfaces of said forme cylinders defining the size of the printed product printed by the printing press;

a folder assembly to cut and fold the various sized products, said folder assembly including cross cutting cylinders, a first take over cylinder, a transfer cylinder, an accelerating conveyor and a longitudinal folding device; said take over cylinder being capable of alternatingly being switched between a collecting mode for collecting a plural number of said printed products together thereon and a non-collecting mode;

means for varying the distance between the axes of said cross cutting cylinders and said first take over cylinders, said distance depending on the size of the printed product;

a switchable gear unit for varying the peripheral speeds of said cross cutting cylinders, take over cylinder, and transfer cylinder in response to the number of printing formes secured to the peripheries of said forme cylinders, said cross cutting cylinders, take over cylinder and transfer cylinder all operating at the same selected peripheral speed with the selected peripheral speed being increased with increasing numbers of printing formes secured to said forme cylinders; and means for varying the peripheral speed of said accelerating conveyor between a first speed which is the same as the peripheral speed of said cross cutting cylinders, take over cylinder and transfer cylinder when said take over cylinder is collecting and a second speed which is twice the peripheral speed of said cross cutting cylinders, take over cylinder and transfer cylinder when said take over cylinder is non-collecting, said accelerating conveyor delivering said printed products to said longitudinal folding device in a spaced array whereby said various sized printed products from said printing press may be severed from the web at the proper locations and folded.

* * * * *